US005246631A

United States Patent [19]

Halbritter

[11] Patent Number: 5,246,631

[45] Date of Patent: Sep. 21, 1993

[54] SELF-ILLUMINATED BUBBLES

[76] Inventor: Martin J. Halbritter, Holy Bakery Rd., Kapaau, Hi. 96755

[21] Appl. No.: 704,776

[22] Filed: May 23, 1991

[51] Int. Cl.[5] ..... C09K 3/00; A63H 33/28

[52] U.S. Cl. ..... 252/700; 446/15

[58] Field of Search ..... 252/582, 700; 446/15, 446/16, 17, 18, 19, 20, 21

[56] References Cited

U.S. PATENT DOCUMENTS

| | | | |
|---|---|---|---|
| 3,749,679 | 7/1973 | Rauhut | 252/700 |
| 3,888,786 | 6/1975 | Maulding | 252/700 |
| 3,911,038 | 10/1975 | Maulding | 252/700 |
| 4,076,645 | 2/1978 | Vega | 252/700 |
| 4,313,843 | 2/1982 | Bollyky et al. | 252/700 |
| 4,379,320 | 4/1983 | Mohan et al. | 252/700 |
| 4,462,931 | 7/1984 | Cohen et al. | 252/700 |
| 4,717,511 | 1/1988 | Koroscil | 252/700 |

*Primary Examiner*—Philip Tucker

*Attorney, Agent, or Firm*—Poms, Smith, Lande & Rose

[57] ABSTRACT

Self-illuminated bubbles are disclosed wherein the bubbles are formed utilizing a bubble blowing solution which includes a sufficient amount of a surface active agent to form the bubbles and a sufficient amount of a chemiluminescent agent to provide self-illumination of the bubbles. The bubble blowing solution includes a surface active agent to provide formation of the bubble and a chemiluminescent agent such as CYALUME®. A kit for preparing the self-illuminated bubble blowing solution is also disclosed.

7 Claims, No Drawings

SELF-ILLUMINATED BUBBLES

BACKGROUND OF THE INVENTION

1. Field of the Invention:

The present invention relates generally to bubbles which are formed for recreational and demonstrative purposes. More particularly, the present invention relates to providing solutions which can be utilized to form self-illuminated bubbles.

2. Description of Related Art:

The formation of bubbles is a well recognized and widely practiced pasttime. In its simplest form, bubble blowing involves dipping a ring-shaped article into a liquid soap solution followed by blowing into the ring to form one or more bubbles. Alternatively, the ring may be moved in order to force air through the ring and form the bubbles.

A wide variety of commercial bubble blowing kits are available for use by individuals. The kits typically include a bubble blowing solution packaged in a suitable container and some type of ring-shaped device for use in forming the bubbles. As an alternative to commercially available bubble blowing kits, individuals commonly practice the art of blowing bubbles utilizing liquid detergents, such as liquid dishwashing, and homemade ring-shaped devices which can be made from a variety of items.

The blowing of bubbles outdoors for recreational and entertainment purposes is limited, for the most part, to daylight hours. Although bubbles can be blown in the dark, the recreational and entertainment value drops substantially since it is difficult to see them. Likewise, bubble blowing indoors is limited to rooms where there is sufficient light to allow visual observation of the bubbles. Accordingly, it would be desirable to provide self-illuminated bubbles which can be viewed under conditions of reduced lighting. The self-illumination of bubbles would also increase the entertainment value and enjoyment of the bubbles under conditions when the bubbles would otherwise be difficult to see. In addition, the self-illumination of bubbles would provide a source of light and illumination in an attractive manner.

SUMMARY OF THE INVENTION

In accordance with the present invention it was discovered that self-illuminated bubbles can be formed which substantially increase the visibility of bubbles when blown in the dark. The self-illuminated bubbles in accordance with the present invention not only are more visible in the dark, but also provide an attractive and appealing source of light. The self-illuminated bubble emits light continuously as the bubble is formed and during the bubbles life as it floats through the air and eventually collapses.

The present invention is based upon the discovery that chemiluminescent agents can be added to conventional bubble blowing solutions in amounts which are sufficient to provide self-illumination of the bubbles without deleteriously affecting the capability of the solution to form suitable bubbles. A bubble blowing solution in accordance with the present invention includes a sufficient amount of a surface-active agent to provide formation of the bubbles when a gas is introduced into contact with the solution and a sufficient amount of a chemiluminescent agent to provide self-illumination of the bubbles. As a feature of the present invention, the chemiluminescent agent is an oxalate diester which reacts with a peroxide and a fluorescer to provide the self-illumination of the bubble. The chemiluminescent agent, such as CYALUME® available from American Cyanamide, can be added to the bubble blowing solution in amounts up to about 20 volume percent.

As a feature of the present invention, it was discovered that bubble hardeners such as glycerin may also be added to the bubble blowing solution in amounts up to about one volume percent to enhance bubble formation. It was discovered that addition of the bubble hardeners does not adversely affect the bubble formation or self-illumination properties of the bubble blowing solution in accordance with the present invention.

The present invention provides a simple and effective method for illuminating bubbles for use in a wide variety of educational, entertainment and recreational settings. The self-illuminated bubbles in accordance with the present invention provide an especially attractive bubble which provides a unique visual glow in the dark. The above-discussed and many other features and attendant advantages of the present invention will become better understood by reference to the following detailed description.

DETAILED DESCRIPTION OF THE INVENTION

The present invention involves self-illuminated bubbles and the solutions used in their preparation. The bubble blowing solutions in accordance with the present invention have wide application for use in a variety of bubble blowing devices. The self-illuminated bubble blowing solution of the present invention may be used in simple ring-shaped bubble blowing devices intended for personalized use. The self-illuminated bubble blowing solution also is suitable for the blowing of bubbles on a larger scale by mechanized equipment.

The present invention is based upon the addition of a chemiluminescent agent to an otherwise conventional bubble blowing solution. The chemiluminescent agent can be added to a wide variety of bubble blowing solutions provided that there is no deleterious reaction between the chemiluminescent agent and the bubble blowing solution. Suitable bubble blowing solutions may include anionic, cationic, non-ionic and ampholytic surfactants. Many of the conventional solutions utilized in bubble blowing kits or in conjunction with bubble blowing machinery are suitable provided that a sufficient amount of a surface active agent is included to provide formation of bubbles when a gas is introduced into contact with the solution.

Solutions containing conventional surfactants, such as sodium laureth sulfate or ammonium laureth sulfate may be utilized. Particularly preferred bubble blowing solutions are liquid s for dishes. The liquid may be used full-strength or may be diluted with water to provide the desired consistency of bubbles depending upon the types of bubbles desired. The amount of water, if any, used to dilute the liquid is not particularly critical and can be varied as is well-known in the art to achieve desired bubble consistency.

The chemiluminescent agent which is added to the bubble blowing solution in accordance with the present invention may be selected from a wide variety of light producing materials. However, the preferred chemiluminescent agent includes an oxalate diester which reacts with a peroxide and a fluorescer to provide the emission of light. This particular light emitting compound and chemiluminescent reaction is well-known and forms the basis for a variety of chemiluminescent compositions.

The composition and chemistry of exemplary chemiluminescent agents is described in detail in U.S. Pat. Nos. 3,749,679; 3,775,336; 3,888,786; 3,911,038; 4,017,415; 4,076,645; 4,313,843; 4,379,320; 4,768,608; and 4,717,511. These patents are all assigned to American Cyanamide Company (Stanford, Connecticut) and are hereby incorporated by reference. A particularly preferred chemiluminescent agent for use in accordance with the present invention is Cyalume® which is a commercially available product which is marketed by American Cyanamide and is covered by the above-identified patents. CYALUME® is available as a kit which can be mixed together following the manufacturers instructions to form the solution which is chemiluminescent.

Bubble hardeners such as glycerin may also be added to the bubble blowing solution in accordance with the present invention. Up to one percent by volume bubble hardener may be added to the solution with approximately 0.2 percent being preferred.

As is well-known, oxalate diesters do not begin to emit light until they are mixed with peroxide and a fluorescer. Once the reaction begins, the period over which light will be emitted can range from a few minutes to a few hours. Accordingly, it is preferred, in accordance with the present invention, that the combination of oxalate diester with a peroxide and a fluorescer be delayed until just prior to use in the bubble blowing solution. Preferably, a bubble blowing kit is provided wherein the bubble blowing solution comprising the surface active agent is packaged separately from the chemiluminescent agent. The kit includes instructions for mixing the chemiluminescent materials together to form the chemiluminescent agent. The instructions further describe the process for mixing the chemiluminescent agent with the bubble blowing solution in order to make the solution light emitting. Alternatively, the bubble blowing solution may contain the oxalate diester with the peroxide and fluorescer being packaged separately.

The amount of chemiluminescent agent which can be added to the bubble blowing solution may be varied in order to provide the desired degree of illumination. Preferably, the amount of chemiluminescent agent will not exceed about 20 volume percent. Larger amounts of chemiluminescent agent do not substantially increase the amount of light emitted and also tend to reduce bubble quality.

An example of practice of the present invention involves using a liquid dish such as LEMON JOY® available from Procter & Gamble Company (Cincinnati, Ohio). This particular dishwashing liquid is covered by U.S. Pat. Nos. 4,133,779 and 4,316,824, the contents of which are hereby incorporated by reference. Although the LEMON JOY® may be diluted with varying amounts of water, it is preferred that the dishwashing liquid be used at full strength. Approximately 9 milliliters of CYALUME® solution made in accordance with the manufacturers instructions are added to approximately 120 milliliters of the dishwashing liquid. Although this particular mixture may be used to produce adequate self-illuminated bubbles, it is preferred that 3 to 4 drops of glycerin be added to the solution as a bubble hardener. The solution is then ready for use to form self-illuminated bubbles.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A self-illuminated bubble comprising a solution containing a sufficient amount of a surface active agent to provide formation of said bubble and a sufficient amount of a chemiluminescent agent to provide self-illumination of said bubble.

2. A self-illuminated bubble according to claim 1 wherein said solution is an aqueous solution.

3. A self-illuminated bubble according to claim 2 wherein said surface active agent is selected from the group of surface active agents consisting of anionic, cationic, non-ionic and ampholytic surfactants.

4. A self-illuminated bubble according to claim 1 wherein said chemiluminescent agent comprises an oxalate diester which reacts with a peroxide and a fluorescer to provide said self-illumination of said bubble.

5. A self-illuminated bubble according to claim 4 wherein said chemiluminescent agent comprises an oxalate diester, said peroxide and said fluorescer.

6. A self-illuminated bubble according to claim 2 wherein said surface active agent is a liquid soap.

7. A self-illuminated bubble according to claim 6 wherein said aqueous solution further comprises less than about 1 volume percent glycerin.

* * * * *